US012130057B2

(12) United States Patent
Saikusa et al.

(10) Patent No.: US 12,130,057 B2
(45) Date of Patent: Oct. 29, 2024

(54) HEAT EXCHANGER, OUTDOOR UNIT, AND REFRIGERATION CYCLE DEVICE

(71) Applicant: Mitsubishi Electric Corporation, Tokyo (JP)

(72) Inventors: Tetsuji Saikusa, Tokyo (JP); Nanami Kishida, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 213 days.

(21) Appl. No.: 17/913,328

(22) PCT Filed: May 22, 2020

(86) PCT No.: PCT/JP2020/020349
§ 371 (c)(1),
(2) Date: Sep. 21, 2022

(87) PCT Pub. No.: WO2021/234956
PCT Pub. Date: Nov. 25, 2021

(65) Prior Publication Data
US 2023/0128871 A1 Apr. 27, 2023

(51) Int. Cl.
*F25B 39/02* (2006.01)

(52) U.S. Cl.
CPC ..... *F25B 39/02* (2013.01)

(58) Field of Classification Search
CPC ..... F25B 39/02; F25B 39/04; F25B 39/028; F25B 2339/044; F25B 2339/0442; F25B 2339/045; F25B 40/00; F25B 40/02
See application file for complete search history.

(56) References Cited

U.S. PATENT DOCUMENTS

2015/0143835 A1* 5/2015 Matsumoto ..... F25B 41/20 62/509
2020/0263911 A1* 8/2020 Haack ..... F25B 41/24
2021/0222893 A1* 7/2021 Matsui ..... F24F 1/18

FOREIGN PATENT DOCUMENTS

JP 2009-257741 A 11/2009
JP 2010107103 A * 5/2010
(Continued)

OTHER PUBLICATIONS

English translation of Mishiro (JP 2010107103 A). (Year: 2010).*
(Continued)

*Primary Examiner* — Miguel A Diaz
(74) *Attorney, Agent, or Firm* — Posz Law Group, PLC

(57) ABSTRACT

A heat exchanger according to the present disclosure includes a main heat exchange unit configured to exchange heat between air and refrigerant, and condense the refrigerant, a subcooling heat exchange unit configured to exchange heat between air and the refrigerant passing through the main heat exchange unit, and subcool the refrigerant passing through the main heat exchange unit, and a connection pipe configured to connect the main heat exchange unit and the subcooling heat exchange unit to allow the refrigerant to pass therethrough, wherein the connection pipe connects the main heat exchange unit on its outflow side to the refrigerant and the subcooling heat exchange unit on its inflow side to the refrigerant, such that when the main heat exchange unit condenses the refrigerant, the refrigerant from the outside flows into the downstream side of the main heat exchange unit and the subcooling heat exchange unit relative to a flow of the air, and flows out from the upstream side of the main heat exchange unit and the subcooling heat exchange unit relative to a flow of the air to form a counter flow in which a flow of the refrigerant is opposite to a flow of the air.

16 Claims, 5 Drawing Sheets

(56) References Cited

FOREIGN PATENT DOCUMENTS

| | | | |
|---|---|---|---|
| JP | 2018-096638 | A | 6/2018 |
| WO | 2013/151008 | A1 | 10/2013 |
| WO | 2019/239446 | A1 | 12/2019 |
| ZA | 2004/04177 | B | 9/2005 |

OTHER PUBLICATIONS

Office Action dated May 9, 2023 issued in corresponding Japanese Patent Application No. 2022-524844 (and English translation).
Extended European Search Report dated May 30, 2023 issued in corresponding European Patent Application No. 20936781.2.
International Search Report of the International Searching Authority mailed Aug. 11, 2020 for the corresponding International application No. PCT/JP2020/020349 (and English translation).

* cited by examiner

HEAT EXCHANGER, OUTDOOR UNIT, AND REFRIGERATION CYCLE DEVICE

CROSS REFERENCE TO RELATED APPLICATION

This application is a U.S. national stage application of PCT/JP2020/020349 filed on May 22, 2020, the contents of which are incorporated herein by reference.

TECHNICAL FIELD

The present technology relates to a heat exchanger, an outdoor unit, and a refrigeration cycle device. Particularly, the present technology relates to a heat exchanger including a main heat exchange unit to condense refrigerant when the heat exchanger functions as a condenser, and a subcooling heat exchange unit to subcool the condensed refrigerant.

BACKGROUND ART

For example, there is a corrugated-fin and tube heat exchanger in which a plurality of flat heat transfer tubes are connected between a pair of headers, and corrugated fins are located between planar portions of the adjacent flat heat transfer tubes. As this type of heat exchanger, there is a heat exchanger including a heat exchange unit to condense refrigerant by exchanging heat, and a subcooling unit to subcool the condensed refrigerant (see, for example, Patent Literature 1).

CITATION LIST

Patent Literature

Patent Literature 1: WO 2013151008

SUMMARY OF INVENTION

Technical Problem

A multi-row heat exchanger may be formed in which a plurality of flat heat transfer tubes are aligned in rows in the direction along the flow of air passing through the heat exchanger to improve its heat transfer performance relative to the size of the heat exchanger. In the multi-row heat exchanger formed as described above, the flow of refrigerant in the heat exchanger affects the heat transfer performance. Particularly, the heat exchanger including the heat exchange unit and the subcooling unit as disclosed in Patent Literature 1 needs to make an improvement to the flow of refrigerant.

The present disclosure has been achieved to solve the above problems, and it is an object of the present disclosure to provide a heat exchanger that can improve its heat transfer performance, an outdoor unit, and a refrigeration cycle device.

Solution to Problem

A heat exchanger according to one embodiment of the present disclosure includes: a main heat exchange unit configured to exchange heat between air and refrigerant, and condense the refrigerant; a subcooling heat exchange unit configured to exchange heat between air and the refrigerant passing through the main heat exchange unit, and subcool the refrigerant passing through the main heat exchange unit; and a connection pipe configured to connect the main heat exchange unit and the subcooling heat exchange unit to allow the refrigerant to pass therethrough, wherein the connection pipe connects the main heat exchange unit on an outflow side to the refrigerant and the subcooling heat exchange unit on an inflow side to the refrigerant, such that when the main heat exchange unit condenses the refrigerant, the refrigerant from outside flows into a downstream side of the main heat exchange unit and the subcooling heat exchange unit relative to a flow of the air, and flows out from an upstream side of the main heat exchange unit and the subcooling heat exchange unit relative to a flow of the air to form a counter flow in which a flow of the refrigerant is opposite to a flow of the air.

An outdoor unit according to another embodiment of the present disclosure includes the heat exchanger according to one embodiment of the present disclosure as an outdoor heat exchanger. A refrigeration cycle device according to still another embodiment of the present disclosure includes the outdoor unit according to another embodiment of the present disclosure.

Advantageous Effects of Invention

According to one embodiment of the present disclosure, the connection pipe connects the main heat exchange unit on its refrigerant outflow side and the subcooling heat exchange unit on its refrigerant inflow side, such that when the heat exchanger functions as a condenser, a counter flow in which a flow of the refrigerant is opposite to a flow of the air is formed in the main heat exchange unit and the subcooling heat exchange unit. Therefore, while the refrigerant passes through the inside of the heat exchanger, the refrigerant and the air can maintain a sufficient temperature difference to be able to exchange heat between them, so that the heat transfer performance in the heat exchanger in its entirety can be improved.

DESCRIPTION OF EMBODIMENTS

Figure 1:
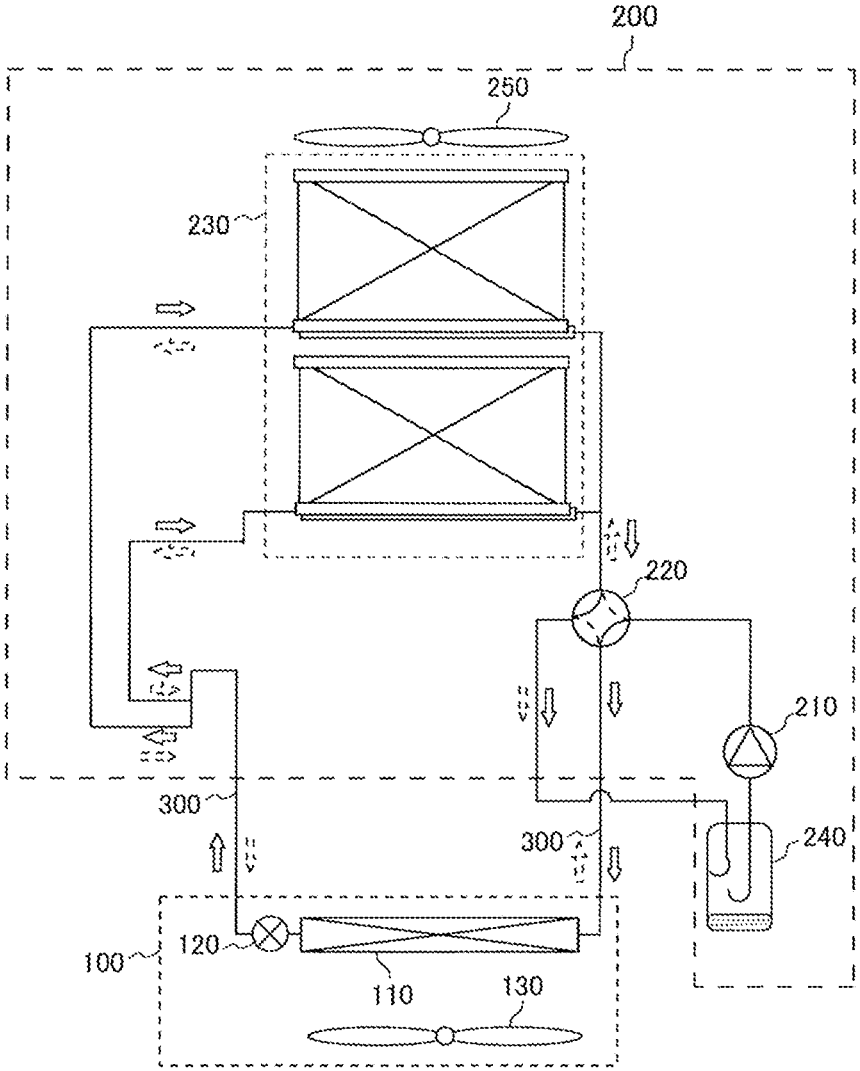
FIG. 1 illustrates the configuration of an air-conditioning apparatus according to Embodiment 1.

Hereinafter, a heat exchanger, an outdoor unit, and a refrigeration cycle device according to the embodiments will be described with reference to the drawings and the like. In the drawings below, like reference signs denote the like or corresponding components, and are common throughout the entire descriptions of the embodiments described below. In addition, the relationship of sizes of the parts in the drawings may differ from that of actual ones. Furthermore, in the cross-sectional view, hatching is omitted in some of the drawings and devices in view of visibility. The forms of the components represented throughout the entire specification are merely examples, and do not intend to limit the components to the forms described in the specification. In particular, the combination of components is not limited to only the combination in each embodiment, and the components described in one embodiment can be applied to another embodiment. Furthermore, the level of the pressure and temperature is not particularly determined in relation to an absolute value, but is determined relative to the conditions or operation of a device or the like. When it is not necessary to distinguish or specify a plurality of devices of the same type that are distinguished from each other by subscripts, the subscripts may be omitted.

Embodiment 1

<Configuration of Air-Conditioning Apparatus>

FIG. 1 illustrates the configuration of an air-conditioning apparatus according to Embodiment 1. The air-conditioning apparatus is now explained as an example of the refrigeration cycle device including a heat exchanger in Embodiment 1.

As illustrated in FIG. 1, the air-conditioning apparatus in Embodiment 1 includes an outdoor unit 200, an indoor unit 100, and two refrigerant pipes 300. The outdoor unit 200 includes a compressor 210, a four-way valve 220, and an outdoor heat exchanger 230. The indoor unit 100 includes an indoor heat exchanger 110 and an expansion valve 120. The compressor 210, the four-way valve 220, the outdoor heat exchanger 230, the indoor heat exchanger 110, and the expansion valve 120 are connected by the refrigerant pipes 300 to form a refrigerant circuit. In the air-conditioning apparatus in Embodiment 1, one outdoor unit 200 and one indoor unit 100 are connected by pipes. However, the number of outdoor units 200 and the number of indoor units 100 to be connected to each other are not limited to this example.

The indoor unit 100 includes an indoor fan 130 in addition to the indoor heat exchanger 110 and the expansion valve 120. The expansion valve 120 that is an expansion device or other device reduces the pressure of refrigerant and expands the refrigerant. When the expansion valve 120 is made up of, for example, an electronic expansion valve, the expansion valve 120 adjusts its opening degree based on an instruction provided by a controller (not illustrated) or other device. The indoor heat exchanger 110 causes heat exchange to be performed between refrigerant and air in a room that is a space to be air-conditioned. For example, during heating operation, the indoor heat exchanger 110 functions as a condenser, and condenses and liquefies the refrigerant. During cooling operation, the indoor heat exchanger 110 functions as an evaporator, and evaporates and vaporizes the refrigerant. The indoor fan 130 allows the air in the room to pass through the indoor heat exchanger 110, and supplies the air having passed through the indoor heat exchanger 110 to the room.

The outdoor unit 200 in Embodiment 1 includes devices forming the refrigerant circuit, such as the compressor 210, the four-way valve 220, the outdoor heat exchanger 230, and an accumulator 240. The outdoor unit 200 includes an outdoor fan 250. The compressor 210 compresses suctioned refrigerant and discharges the compressed refrigerant. The compressor 210 is, for example, a scroll compressor, a reciprocating compressor, or a vane compressor. For example, the compressor 210 may allow an inverter circuit to optionally change the operational frequency to change the capacity of the compressor 210, although the configuration of the compressor 210 is not particularly limited.

For example, the four-way valve 220 that serves as a flow switching device is a valve to change the flow direction of refrigerant depending on cooling operation or heating operation. When heating operation is performed, the four-way valve 220 connects the discharge side of the compressor 210 to the indoor heat exchanger 110, while connecting the suction side of the compressor 210 to the outdoor heat exchanger 230. When cooling operation is performed, the four-way valve 220 connects the discharge side of the compressor 210 to the outdoor heat exchanger 230, while connecting the suction side of the compressor 210 to the indoor heat exchanger 110. A case where the four-way valve 220 is used is described as an example, however, the flow switching device is not limited to this case. For example, a plurality of two-way valves or other valves may be combined to form the flow switching device. The accumulator 240 is installed on the suction side of the compressor 210. The accumulator 240 allows refrigerant in gas form (hereinafter, referred to as "gas refrigerant") to pass through the accumulator 240, while accumulating refrigerant in liquid form (hereinafter, referred to as "liquid refrigerant") in the accumulator 240.

The outdoor heat exchanger 230 causes heat exchange to be performed to be performed between refrigerant and outdoor air. Refrigerant is fluid to serve as a heat exchange medium for the outdoor heat exchanger 230. The outdoor heat exchanger 230 in Embodiment 1 functions as an evaporator during heating operation, and evaporates and vaporizes the refrigerant. In contrast, during cooling operation, the outdoor heat exchanger 230 functions as a condenser and a subcooling device, and condenses and liquefies the refrigerant to be subcooled. As will be described later, the outdoor heat exchanger 230 in Embodiment 1 includes heat exchangers 1, each of which includes a heat exchanger unit 10 made up of a main heat exchange unit 10A and a subcooling heat exchange unit 10B. The heat exchanger 1 will be described later in detail. The outdoor fan 250 is driven to allow air from the outside of the outdoor unit 200 to pass through the outdoor heat exchanger 230 to form a flow of air that flows out of the outdoor unit 200.

<Operation of Air-Conditioning Apparatus>

Next, operation of each device in the air-conditioning apparatus is described based on the flow of refrigerant. First, operation of each device in the refrigerant circuit during heating operation is described based on the flow of refrigerant. The solid arrows in FIG. 1 show the flow of refrigerant during heating operation. High-temperature and high-pressure gas refrigerant, compressed by and discharged from the compressor 210, passes through the four-way valve 220, and then flows into the indoor heat exchanger 110. While passing through the indoor heat exchanger 110, the gas refrigerant exchanges heat with air in, for example, a space to be air-conditioned, and thereby condenses into liquid. The refrigerant having condensed into liquid passes through the expansion valve 120. When the refrigerant passes through the expansion valve 120, the pressure of the refrigerant is reduced. The refrigerant, reduced in pressure by the expansion valve 120 and brought into a two-phase gas-liquid state, passes through the outdoor heat exchanger 230. In the outdoor heat exchanger 230, the refrigerant exchanges heat with outdoor air delivered from the outdoor fan 250, and thereby evaporates into gas. The gas refrigerant passes through the four-way valve 220 and the accumulator 240, and then is suctioned into the compressor 210 again. In the manner as described above, refrigerant of the air-conditioning apparatus circulates, and thus the air-conditioning apparatus performs heating-related air conditioning.

Next, cooling operation is described. The dotted arrows in FIG. 1 show the flow of refrigerant during cooling operation. High-temperature and high-pressure gas refrigerant, compressed by and discharged from the compressor 210, passes through the four-way valve 220, and then flows into the outdoor heat exchanger 230. In the outdoor heat exchanger 230, the refrigerant passes through the main heat exchange unit 10A of the heat exchanger 1, exchanges heat with outdoor air supplied by the outdoor fan 250, and thereby condenses into liquid. The heat exchanger 1 will be described later. The liquid refrigerant further passes through the subcooling heat exchange unit 10B of the heat exchanger 1 that will be described later, exchanges heat with outdoor air supplied by the outdoor fan 250, and is thereby subcooled. The subcooled refrigerant passes through the expansion valve 120. When passing through the expansion valve 120, the subcooled refrigerant is reduced in pressure and brought into a two-phase gas-liquid state. This refrigerant, reduced in pressure by the expansion valve 120 and brought into a two-phase gas-liquid state, then passes through the indoor heat exchanger 110. In the indoor heat exchanger 110, the refrigerant, having exchanged heat with air in, for example, the space to be air-conditioned and thereby being evaporated into gas, passes through the four-way valve 220, and is suctioned into the compressor 210 again. In the manner as described above, refrigerant of the air-conditioning apparatus circulates, and thus the air-conditioning apparatus performs cooling-related air conditioning.

<Configuration of Heat Exchanger 1>

Figure 2:
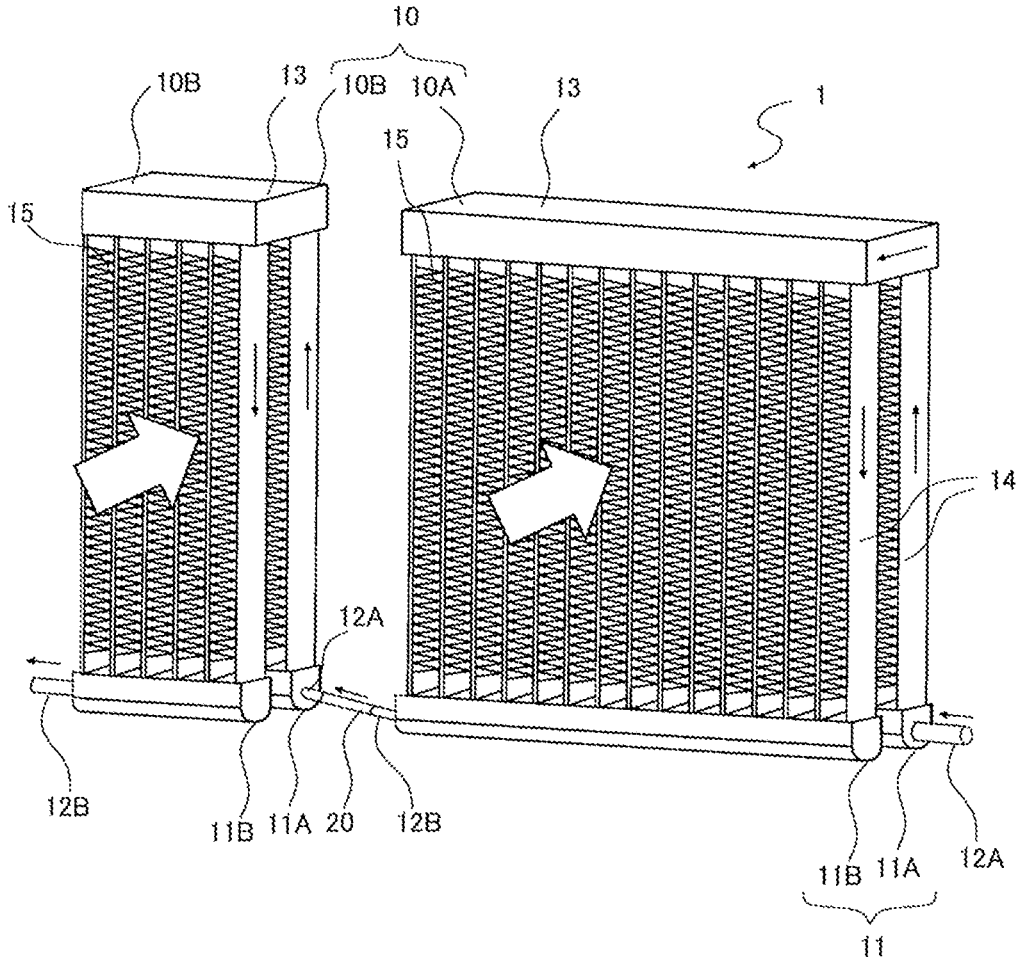
FIG. 2 is an explanatory view of a heat exchanger 1 according to Embodiment 1.

FIG. 2 is an explanatory view of the heat exchanger 1 according to Embodiment 1. As described above, the outdoor heat exchanger 230 according to Embodiment 1 includes the heat exchangers 1. The heat exchanger 1 illustrated in FIG. 2 includes the heat exchanger unit 10 made up of the main heat exchange unit 10A and the subcooling heat exchange unit 10B, and further includes a connection pipe 20. The heat exchanger unit 10 (the main heat exchange unit 10A and the subcooling heat exchange unit 10B) causes heat exchange to be performed between refrigerant and outdoor air. The connection pipe 20 in Embodiment 1 connects the main heat exchange unit 10A and the subcooling heat exchange unit 10B. The connection relationship of the connection pipe 20 in Embodiment 1 will be described later. FIG. 2 illustrates the configuration of the heat exchanger 1 separated into the main heat exchange unit 10A and the subcooling heat exchange unit 10B, and connecting the main heat exchange unit 10A and the subcooling heat exchange unit 10B that are independent from each other by the connection pipe 20 to show the flow of refrigerant in the main heat exchange unit 10A separately from the flow of refrigerant in the subcooling heat exchange unit 10B. However, the heat exchanger 1 is not limited to having this configuration. The heat exchanger 1 may have such a configuration as to integrate the main heat exchange unit 10A and the subcooling heat exchange unit 10B into one, and thus partition the interior of lower headers 11 and the interior of a return header 13 into spaces for the main heat exchange unit 10A and the subcooling heat exchange unit 10B. Furthermore, the heat exchanger 1 may have such a configuration that a receiver to accumulate liquid refrigerant therein is installed on the connection pipe 20.

In Embodiment 1, the subcooling heat exchange unit 10B of the heat exchanger 1 has a flow-passage area smaller than that in the main heat exchange unit 10A of the heat exchanger 1. Therefore, in the heat exchanger 1 in Embodiment 1, the subcooling heat exchange unit 10B has a volume smaller than that of the main heat exchange unit 10A in proportion to the flow-passage area in the subcooling heat exchange unit 10B. The ratio of the flow-passage area in the main heat exchange unit 10A to the flow-passage area in the subcooling heat exchange unit 10B is set to, for example, approximately 75 to 25 (=3 to 1). The main heat exchange unit 10A has a flow-passage area that is approximately three times as large as the flow-passage area in the subcooling heat exchange unit 10B. Accordingly, refrigerant in the subcooling heat exchange unit 10B flows at a higher velocity than in the main heat exchange unit 10A. This enables the heat exchanger 1 to maintain the balance between condensation in the main heat exchange unit 10A and subcooling in the subcooling heat exchange unit 10B. However, due to the environmental differences, the ratio between the flow-passage areas is not limited to the ratio described as an example. As described above, the subcooling heat exchange unit 10B has a flow-passage area smaller than that in the main heat exchange unit 10A, and refrigerant flows from the main heat exchange unit 10A to the subcooling heat exchange unit 10B. Accordingly, liquid refrigerant in the subcooling heat exchange unit 10B flows at a higher velocity relative to the main heat exchange unit 10A.

The heat exchanger unit 10 is a corrugated-fin and tube heat exchanger that is a parallel pipe heat exchanger. The heat exchanger unit 10 includes two lower headers 11 (a lower header 11A and a lower header 11B), the return header 13, a plurality of flat heat transfer tubes 14, and a plurality of corrugated fins 15. In the heat exchanger unit 10 in Embodiment 1, the flat heat transfer tubes 14 that serve as a flow passage of refrigerant are aligned in two rows in the air passage direction. The heat exchanger unit 10 in which the flat heat transfer tubes 14 are aligned in two rows is now described as an example. However, the heat exchanger unit 10 in which the flat heat transfer tubes 14 are aligned in three or more rows is also applicable.

In the heat exchanger unit 10 in Embodiment 1, the two lower headers 11 are located separately from the return header 13 on either the upper or lower side in the height direction. In this example, the return header 13 is positioned on the upper side, while the two lower headers 11 are positioned on the lower side relative to the return header 13. Conversely, the lower headers 11 may be positioned on the upper side, while the return header 13 may be positioned on the lower side. In the explanations below, the up-down direction in FIG. 2 is defined as a height direction. The left-right direction in FIG. 2 is defined as a horizontal direction. The front-rear direction in FIG. 2 is defined as a depth direction.

Between the two lower headers 11 and the return header 13, a group of a plurality of flat heat transfer tubes 14 are aligned in two rows to be perpendicular to the lower headers 11 and the return header 13 with the flat surfaces of the flat heat transfer tubes 14 facing parallel to each other. A group of the flat heat transfer tubes 14 aligned in one of the rows are connected to one of the lower headers 11.

The lower headers 11 are connected by pipes to other devices that make up the refrigeration cycle device. Each of the lower headers 11 is a pipe through which refrigerant flows into and out of the heat exchanger 1, and the refrigerant is distributed or joins together. The refrigerant is fluid serving as a heat exchange medium. The lower headers 11 respectively include refrigerant inlet/outlet pipes 12 (a refrigerant inlet/outlet pipe 12A and a refrigerant inlet/outlet pipe 12B) through which refrigerant flows in from and out to the outside. The return header 13 serves as a bridge that allows refrigerant, flowing from a group of the flat heat transfer tubes 14 aligned in one of the rows, to join together, and then distributes the refrigerant to flow out to a group of the flat heat transfer tubes 14 aligned in the other row.

Each of the flat heat transfer tubes 14 has an elongated shape in cross-section in which the outer surface on the longitudinal side of the elongated shape along the depth direction that is an air flow direction is flat, while the outer surface on the relatively short side of the elongated shape perpendicular to the longitudinal direction is curved. Each of the flat heat transfer tubes 14 in Embodiment 1 is a multi-hole flat heat transfer tube having a plurality of holes serving as a flow passage of refrigerant inside the tube. In Embodiment 1, since the holes of the flat heat transfer tubes 14 serve as a flow passage extending between the lower headers 11 and the return header 13, these holes are formed in the height direction. As described above, the flat heat transfer tubes 14 are aligned with equal spacing in the horizontal direction with their outer surfaces on the longitudinal side facing each other. In the process of manufacturing the heat exchanger unit 10 in Embodiment 1, each of the flat heat transfer tubes 14 is inserted into an insertion hole (not illustrated) formed on the lower header 11 and an insertion hole (not illustrated) formed on the return header 13 to be brazed and joined to the lower header 11 and the return header 13. Examples of the brazing material to be used include an aluminum-containing brazing material. With this brazing, the inside of each of the flat heat transfer tubes 14 communicates with the lower header 11 and the return header 13.

The corrugated fins 15 are located between the opposite flat surfaces of the flat heat transfer tubes 14 aligned in a row. The corrugated fins 15 are located to increase the heat transfer area between refrigerant and outside air. Each of the corrugated fins 15 is formed by corrugating a plate material into a wavy shape in which the plate material is folded in a zigzag pattern with a series of alternate crest folds and valley folds. The folded portions of protrusions and recesses formed into a wavy shape are the peaks of the wavy shape. In Embodiment 1, the peaks of the corrugated fins 15 are arranged along the height direction. Each of the corrugated fins 15 is in surface contact at the peaks of the wavy shape with the flat surfaces of the flat heat transfer tubes 14. The contact portions are brazed and joined to each other by using a brazing material. The plate material for the corrugated fins 15 is made of, for example, aluminum alloy. The surface of the plate material is coated with a layer of brazing material. The coating layer of brazing material is, for example, based on a brazing material containing aluminum silicon-based aluminum.

In the heat exchanger unit 10 of the heat exchanger 1 in Embodiment 1, when the heat exchanger unit 10 is used as a condenser and a subcooling device, high-temperature and high-pressure refrigerant flows through the refrigerant flow passages inside the flat heat transfer tubes 14. When the heat exchanger unit 10 is used as an evaporator, low-temperature and low-pressure refrigerant flows through the refrigerant flow passages inside the flat heat transfer tubes 14.

The arrows illustrated in FIG. 2 show the flow of refrigerant when the heat exchanger 1 in Embodiment 1 is used as a condenser and a subcooling device. As described for the heat exchanger 1 in Embodiment 1, when the heat exchanger 1 is used as a condenser or a subcooling device, refrigerant flows to form a counter flow to the flow of air. The counter flow refers to a flow of refrigerant that flows from a row of the flat heat transfer tubes 14 located downstream of the flow of air toward another row of the flat heat transfer tubes 14 located upstream of the flow of air. In the heat exchanger 1 in Embodiment 1, the connection pipe 20 connects the refrigerant inlet/outlet pipe 12B and the refrigerant inlet/outlet pipe 12A. The refrigerant inlet/outlet pipe 12B is located on the refrigerant outflow side of the main heat exchange unit 10A serving as a condenser of the heat exchanger 1. The refrigerant inlet/outlet pipe 12A is located on the refrigerant inflow side of the subcooling heat exchange unit 10B serving as a subcooling device of the heat exchanger 1.

As illustrated in FIG. 2, refrigerant delivered from the compressor 210 flows via the refrigerant inlet/outlet pipe 12A into the lower header 11A of the main heat exchange unit 10A. The lower header 11A is connected to a row of the flat heat transfer tubes 14 located most downstream of the flow of air. Since the heat exchanger unit 10 in Embodiment 1 is of two-row configuration, the term "most downstream" is hereinafter described as "downstream." Refrigerant flowing into the lower header 11A of the main heat exchange unit 10A is distributed and passes through a row of the flat heat transfer tubes 14 located downstream of the flow of air. The flat heat transfer tubes 14 causes heat exchange to be performed between refrigerant passing through the inside of the tubes and outside air passing outside the tubes. At this time, the refrigerant transfers heat to the outside air, while passing through the flat heat transfer tubes 14.

Then, the refrigerant is returned at the return header 13, passes through a row of the flat heat transfer tubes 14 located upstream of the flow of air, and exchanges heat with the air. Then, this refrigerant flows into the lower header 11B of the main heat exchange unit 10A and joins together. In a case where the flat heat transfer tubes 14 are aligned in three or more rows along the flow of air, refrigerant passes through a row of the flat heat transfer tubes 14 located upstream of the flow of air to repetitively exchange heat with air. Liquid refrigerant, having joined together in the lower header 11B located most upstream of the flow of air, passes through the connection pipe 20 via the refrigerant inlet/outlet pipe 12B connected to the lower header 11B.

Refrigerant having passed through the connection pipe 20 flows via the refrigerant inlet/outlet pipe 12A into the lower header 11A of the subcooling heat exchange unit 10B. The lower header 11A is connected to a group of the flat heat transfer tubes 14 aligned in a row located downstream of the flow of air. Refrigerant flowing into the lower header 11A of the subcooling heat exchange unit 10B is distributed and passes through a row of the flat heat transfer tubes 14 located downstream of the flow of air. Refrigerant, having passed through a row of the flat heat transfer tubes 14 located downstream of the flow of air, is further returned at the return header 13. Then, the refrigerant passes through a row of the flat heat transfer tubes 14 located upstream of the flow of air, and is subcooled. Thereafter, the refrigerant flows into the lower header 11B of the subcooling heat exchange unit 10B and joins together. The liquid refrigerant having joined together passes through the refrigerant inlet/outlet pipe 12B connected to the lower header 11B, and flows out of the heat exchanger 1. Then, this liquid refrigerant passes through the refrigerant pipes 300 and is delivered to the expansion valve 120 of the indoor unit 100.

In a row of the flat heat transfer tubes 14 located downstream of the flow of air, heat is exchanged between refrigerant, not having yet exchanged heat with air, and air having already exchanged heat with refrigerant in a row of the flat heat transfer tubes 14 located upstream of the flow of air. In contrast, in a row of the flat heat transfer tubes 14 located upstream of the flow of air, heat is exchanged between refrigerant, having already exchanged heat with air in a row of the flat heat transfer tubes 14 located downstream of the flow of air, and air not having yet exchanged heat with refrigerant. Therefore, in both a row of the flat heat transfer tubes 14 located upstream of the flow of air, and a row of the flat heat transfer tubes 14 located downstream of the flow of air, a sufficient temperature difference between refrigerant and air can be maintained to effectively exchange heat between them. Particularly, even in the subcooling heat exchange unit 10B in which liquid refrigerant flows whose heat transfer properties are inferior to those of gas refrigerant, the refrigerant flows to form a counter flow to the flow of air, so that the heat transfer performance still improves.

As described above, in the heat exchanger 1 that serves as the outdoor heat exchanger 230 of the air-conditioning apparatus in Embodiment 1, when the heat exchanger 1 is used as a condenser and a subcooling device, refrigerant flows in the heat exchanger unit 10 to form a counter flow to the flow of air passing through the heat exchanger 1. Due to this configuration, the heat exchanger 1 can maintain a sufficient temperature difference between refrigerant and air to effectively cause heat exchange to be performed between them throughout the entire refrigerant flow passage, and can consequently improve the heat transfer performance of the heat exchanger 1. In addition, the heat exchanger 1 in Embodiment 1 has such a configuration that the subcooling heat exchange unit 10B has a flow-passage area smaller than that in the main heat exchange unit 10A. Due to this configuration, the heat exchanger 1 can increase the flow velocity of refrigerant in the subcooling heat exchange unit 10B, even when the refrigerant condenses into liquid form in the main heat exchange unit 10A and thus flows at a velocity decreased relative to gas refrigerant.

Embodiment 2

Figure 3:
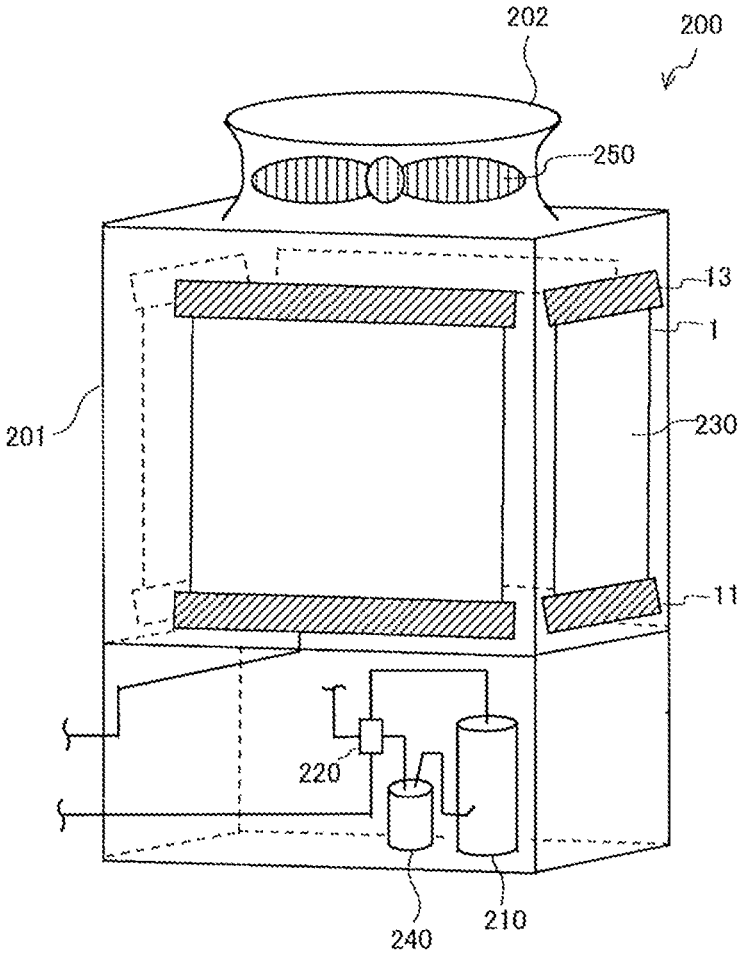
FIG. 3 is an explanatory view illustrating the configuration of an outdoor unit 200 according to Embodiment 2.

FIG. 3 is an explanatory view illustrating the configuration of the outdoor unit 200 according to Embodiment 2. The outdoor unit 200 in Embodiment 2 is a top-flow outdoor unit including an air outlet 202 of the outdoor fan 250 at the center of the upper portion of a housing 201. In the outdoor unit 200, a plurality of heat exchangers 1, such as heat exchangers with an L-shape when viewed from the top side, are combined into the outdoor heat exchanger 230. The plurality of heat exchangers 1 are combined in a rectangular shape when viewed from the top side, and are located at the upper position on the sides of the housing 201 of the outdoor unit 200 in such a manner as to surround the outdoor fan 250.

When the outdoor heat exchanger 230 is used as a condenser and a subcooling device, a row of the flat heat transfer tubes 14 located upstream of the flow of refrigerant is defined as an inner row, while a row of the flat heat transfer tubes 14 located upstream of the flow of air is defined as an outer row. Due to this configuration, high-temperature and high-pressure refrigerant delivered from the compressor 210 flows through the inner row, and then this refrigerant, having condensed with its temperature having decreased in the inner row, flows through the outer row, so that the outdoor unit 200 can maintain safety.

In Embodiment 1, the heat exchanger 1 includes the heat exchanger unit 10 made up of the main heat exchange unit 10A and the subcooling heat exchange unit 10B. In Embodiment 2, an explanation is given for allocation between the main heat exchange unit 10A and the subcooling heat exchange unit 10B in the outdoor heat exchanger 230 in its entirety formed by combining the plurality of heat exchangers 1 in a rectangular shape. In view of the above, the outdoor heat exchanger 230 may include the heat exchanger 1 made up of only the main heat exchange unit 10A, and the heat exchanger 1 made up of only the subcooling heat exchange unit 10B.

Figure 4:
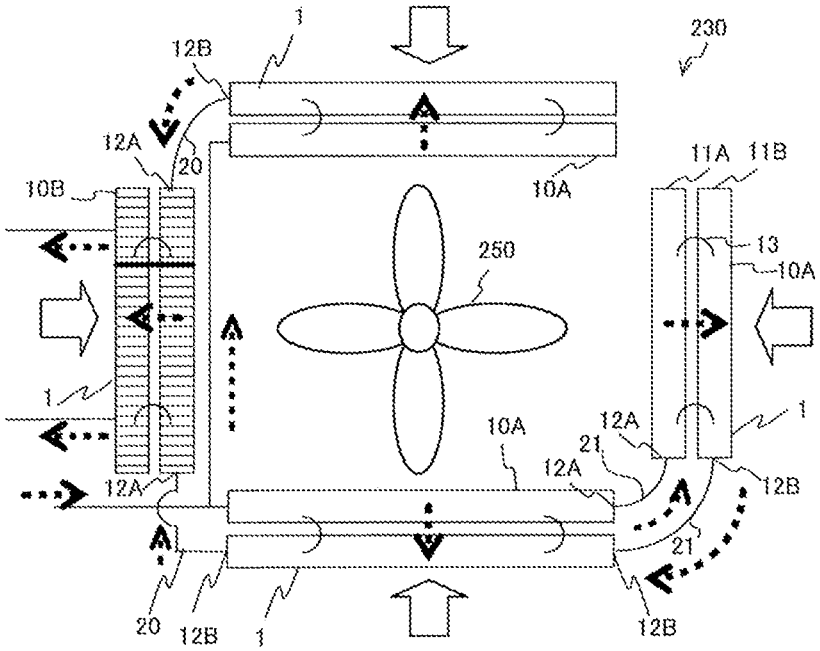
FIG. 4 is an explanatory view illustrating an example of the configuration of an outdoor heat exchanger 230 in the outdoor unit 200 according to Embodiment 2.

FIG. 4 is an explanatory view illustrating an example of the configuration of the outdoor heat exchanger 230 in the outdoor unit 200 according to Embodiment 2. FIG. 4 illustrates the return header 13 in a simplified form. In FIG. 4, four heat exchangers 1 are combined in a rectangular shape, and three of the four heat exchangers 1 are assumed to be the main heat exchange units 10A, while the remaining one of the four heat exchangers 1 is assumed to be the subcooling heat exchange unit 10B. In FIG. 4, the thick open arrows show the flow of air, while the dotted arrows show the flow of refrigerant. The subcooling heat exchange unit 10B is partitioned into sub-inner spaces.

In Embodiment 2, a plurality of heat exchangers, each of which includes the main heat exchange unit 10A, are connected by using pipes 21. When the heat exchangers 1, each of which includes the main heat exchange unit 10A, are connected by using the pipes 21, one of the pipes 21 connects the refrigerant inlet/outlet pipes 12A to each other, while the other pipe 21 connects the refrigerant inlet/outlet pipes 12B to each other. In the heat exchanger 1 in Embodiment 2, each of the connection pipes 20 connects the refrigerant inlet/outlet pipe 12B and the refrigerant inlet/outlet pipe 12A. When the heat exchanger 1 is used as a condenser and a subcooling device, the refrigerant inlet/outlet pipe 12B is located on the refrigerant outflow side of the main heat exchange unit 10A, while the refrigerant inlet/outlet pipe 12A is located on the refrigerant inflow side of the subcooling heat exchange unit 10B. The outdoor heat exchanger 230 is configured in the manner as illustrated in FIG. 4, and consequently can improve its heat transfer performance. In the outdoor heat exchanger 230 in FIG. 4, the heat exchangers 1 made up of the main heat exchange units 10A can be formed separately to be independent from the heat exchanger 1 made up of the subcooling heat exchange unit 10B.

Figure 5:
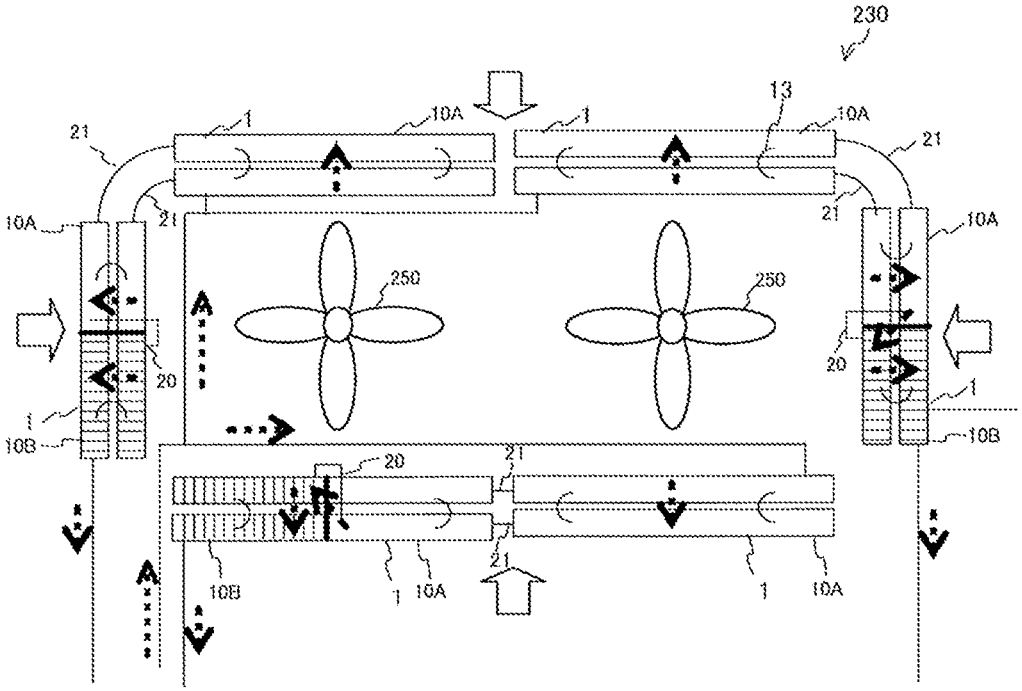
FIG. 5 is an explanatory view illustrating another example of the configuration of the outdoor heat exchanger 230 in the outdoor unit 200 according to Embodiment 2.

FIG. 5 is an explanatory view illustrating another example of the configuration of the outdoor heat exchanger 230 in the outdoor unit 200 according to Embodiment 2. FIG. 5 illustrates the return header 13 in a simplified form. In FIG. 5, six heat exchangers 1 are located in such a manner as to surround two outdoor fans 250. In three of the six heat exchangers 1, the main heat exchange unit 10A and the subcooling heat exchange unit 10B are integrated into one. Each of the other three heat exchangers 1 is made up of only the main heat exchange unit 10A. Due to this configuration, in the heat exchanger 1 in which the main heat exchange unit 10A and the subcooling heat exchange unit 10B are integrated into one, the main heat exchange unit 10A and the subcooling heat exchange unit 10B have equal volume. In the outdoor heat exchanger 230 in its entirety, the ratio of the flow-passage area in the main heat exchange unit 10A to the flow-passage area in the subcooling heat exchange unit 10B is set to 75 to 25. Even when the outdoor heat exchanger 230 is configured in the manner as illustrated in FIG. 5, the outdoor heat exchanger 230 can still improve its heat transfer performance by the connection pipes 20, each of which connects the refrigerant inlet/outlet pipe 12B and the refrigerant inlet/outlet pipe 12A. The refrigerant inlet/outlet pipe 12B is located on the refrigerant outflow side of the main heat exchange unit 10A. The refrigerant inlet/outlet pipe 12A is located on the refrigerant inflow side of the subcooling heat exchange unit 10B.

Embodiment 3

In Embodiments 1 and 2 explained above, when the heat exchanger 1 is used as a condenser and a subcooling device, refrigerant in the heat exchanger unit 10 flows to form a counter flow to the flow of air passing through the heat exchanger 1. In the explanations in Embodiments 1 and 2, the type of refrigerant is not particularly specified. In a case where refrigerant that circulates in the refrigerant circuit is a non-azeotropic refrigerant mixture, it is particularly effective to allow this refrigerant to flow in the heat exchanger 1 oppositely to the flow of air. Examples of the non-azeotropic refrigerant mixture include a hydrofluorocarbon (HFC) refrigerant such as R4070 (R32/R125/R134a).

Figure 6:
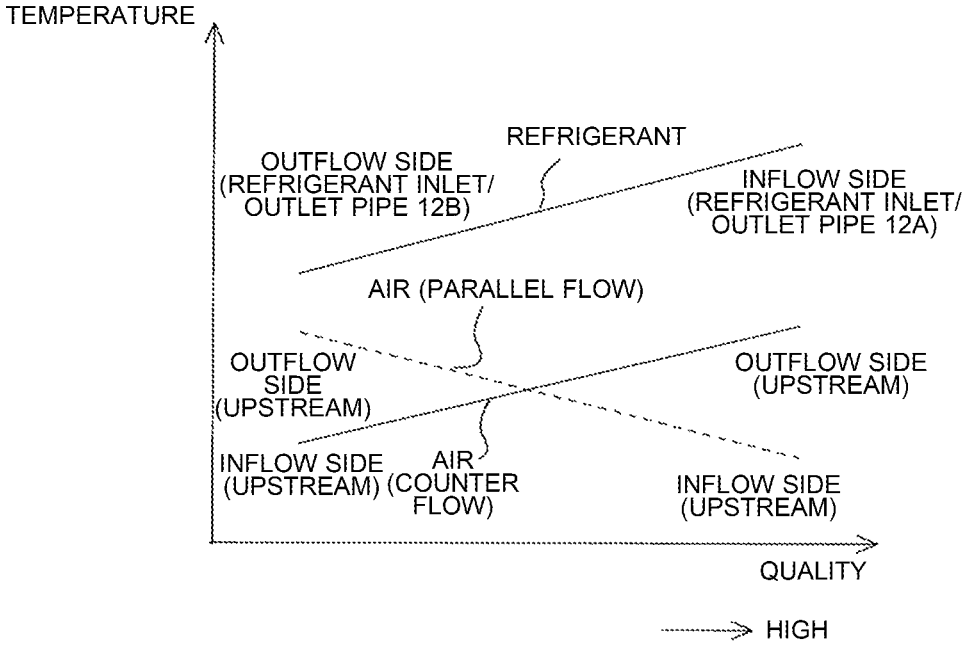
FIG. 6 is an explanatory graph illustrating the relationship between the temperature of air passing through the heat exchanger 1 and the quality of refrigerant in a heat exchanger unit 10 according to Embodiment 3.

FIG. 6 is an explanatory graph illustrating the relationship between the temperature of air passing through the heat exchanger 1 and the quality of refrigerant in the heat exchanger unit 10 according to Embodiment 3. The solid line shows the temperature of air from the inflow side to the outflow side when the counter flow described above is formed. The dotted line shows the temperature of air from the outflow side to the inflow side when a parallel flow is formed. When a parallel flow is formed, refrigerant, flowing into the lower header 11B, passes through a row of the flat heat transfer tubes 14 located upstream of the flow of air, passes through the return header 13, and then passes through a row of the flat heat transfer tubes 14 located downstream of the flow of air. Thereafter, the refrigerant flows out of the lower header 11A.

As illustrated in FIG. 6, when a parallel flow is formed, as the flow of refrigerant approaches the outlet, a temperature difference between refrigerant and air becomes less significant. A non-azeotropic refrigerant mixture is made up of plural types of refrigerants with different boiling points. Under a given pressure, a non-azeotropic refrigerant mixture starts condensing at a temperature different from the temperature at which the non-azeotropic refrigerant mixture finishes condensing. For this reason, as the quality of non-azeotropic refrigerant mixture is decreased due to condensation, the non-azeotropic refrigerant mixture condenses at a lower temperature. Therefore, as the non-azeotropic refrigerant mixture condenses at a lower temperature, the temperature difference between the refrigerant and air becomes less significant. Consequently, the refrigerant cannot maintain a sufficient temperature difference from air to effectively exchange heat with the air. As described above, there is a counter-flow relationship between the flow of refrigerant and the flow of air, so that even the non-azeotropic refrigerant mixture can still maintain a sufficient temperature difference from air to effectively exchange heat with the air on the refrigerant outflow side.

INDUSTRIAL APPLICABILITY

In Embodiment 1 described above, the heat exchangers 1 are used as the outdoor heat exchanger 230 of the outdoor unit 200, however, use of the heat exchangers 1 is not limited to this example. The heat exchangers 1 may be used as the indoor heat exchanger 110 of the indoor unit 100, or may be used as both the outdoor heat exchanger 230 and the indoor heat exchanger 110.

In Embodiment 1 described above, the air-conditioning apparatus has been explained. However, the heat exchanger 1 is also applicable to other refrigeration cycle devices, such as a refrigerator, a freezer, or a water heater.

In Embodiment 1 described above, both the main heat exchange unit 10A and the subcooling heat exchange unit 10B are corrugated-fin and tube heat exchangers. However, either the main heat exchange unit 10A or the subcooling heat exchange unit 10B may only be a corrugated-fin and tube heat exchanger.

REFERENCE SIGNS LIST

1: heat exchanger, 10: heat exchanger unit, 10A: main heat exchange unit, 10B: subcooling heat exchange unit, 11, 11A, 11B: lower header, 12, 12A, 12B: refrigerant inlet/outlet pipe, 13: return header, 14: flat heat transfer tube, 15: corrugated fin, 20: connection pipe, 21: pipe, 100: indoor unit, 110: indoor heat exchanger, 120: expansion valve, 130: indoor fan, 200: outdoor unit, 201: housing, 202: air outlet, 210: compressor, 220: four-way valve, 230: outdoor heat exchanger, 240: accumulator, 250: outdoor fan, 300: refrigerant pipe

The invention claimed is:

1. A heat exchanger comprising:

a main heat exchange unit that includes a first return header and a first lower header inside which refrigerant passes through, the first return header and the first lower header being spaced apart from each other in an up-down direction, and that is configured to cause heat exchange to be performed between air and the refrigerant, and to condense the refrigerant;

a subcooling heat exchange unit that includes a second return header and a second lower header inside which the refrigerant passes through, the second return header and the second lower header being spaced apart from each other in the up-down direction, and that is configured to cause heat exchange to be performed between air and the refrigerant passing through the main heat exchange unit, and to subcool the refrigerant passing through the main heat exchange unit; and a connection pipe configured to connect the main heat exchange unit and the subcooling heat exchange unit to allow the refrigerant to pass therethrough, wherein the connection pipe connects the first lower header located upstream of the flow of air in the main heat exchange unit on an outflow side to the refrigerant and the second lower header located downstream of the flow of air in the subcooling heat exchange unit on an inflow side to the refrigerant, such that when the main heat exchange unit condenses the refrigerant, the refrigerant from outside flows into a downstream side of the main heat exchange unit and the subcooling heat exchange unit relative to a flow of the air, and flows out from an upstream side of the main heat exchange unit and the subcooling heat exchange unit relative to a flow of the air to form a counter flow in which a flow of the refrigerant is opposite to a flow of the air.

2. The heat exchanger of claim 1, wherein at least one of the main heat exchange unit and the subcooling heat exchange unit includes a plurality of flat heat transfer tubes, each of which has an elongated shape in cross-section, the plurality of flat heat transfer tubes being spaced from each other and located in at least one of a location between the first return header and the first lower header and a location between the second return header and the second lower header, each of the plurality of flat heat transfer tubes having flat surfaces on longitudinal sides of the elongated shape facing each other, each of the plurality of flat heat transfer tubes having flow passages therein, through which the refrigerant flows, and a plurality of corrugated fins located between two of the flat heat transfer tubes adjacent to each other, and joined to the flat heat transfer tubes on the flat surfaces.

3. The heat exchanger of claim 2, wherein at least one of the main heat exchange unit and the subcooling heat exchange unit has a configuration in which the flat heat transfer tubes are located in a plurality of rows along a flow direction of the air, the refrigerant flows in from the flat heat transfer tubes in a most downstream one of the rows relative to a flow of the air, passes through the flat heat transfer tubes in an upstream one of the rows relative to a flow of the air, and then flows out of the flat heat transfer tubes in a most upstream one of the rows relative to a flow of the air.

4. The heat exchanger of claim 1, wherein the subcooling heat exchange unit has a flow-passage area smaller than a flow-passage area in the main heat exchange unit.

5. The heat exchanger of claim 4, wherein a ratio of a flow-passage area in the subcooling heat exchange unit to a flow-passage area in the main heat exchange unit is 1 to 3.

6. The heat exchanger of claim 1, wherein the refrigerant is a non-azeotropic refrigerant mixture.

7. An outdoor unit comprising the heat exchanger of claim 1 as an outdoor heat exchanger.

8. A refrigeration cycle device comprising the outdoor unit of claim 7.

9. The heat exchanger of claim 2, wherein the subcooling heat exchange unit has a flow-passage area smaller than a flow-passage area in the main heat exchange unit.

10. The heat exchanger of claim 9, wherein a ratio of a flow-passage area in the subcooling heat exchange unit to a flow-passage area in the main heat exchange unit is 1 to 3.

11. The heat exchanger of claim 3, wherein the subcooling heat exchange unit has a flow-passage area smaller than a flow-passage area in the main heat exchange unit.

12. The heat exchanger of claim 11, wherein a ratio of a flow-passage area in the subcooling heat exchange unit to a flow-passage area in the main heat exchange unit is 1 to 3.

13. The heat exchanger of claim 2, wherein the refrigerant is a non-azeotropic refrigerant mixture.

14. The heat exchanger of claim 3, wherein the refrigerant is a non-azeotropic refrigerant mixture.

15. The heat exchanger of claim 4, wherein the refrigerant is a non-azeotropic refrigerant mixture.

16. The heat exchanger of claim 5, wherein the refrigerant is a non-azeotropic refrigerant mixture.

* * * * *